US008070309B2

(12) United States Patent
Otsuki et al.

(10) Patent No.: US 8,070,309 B2
(45) Date of Patent: Dec. 6, 2011

(54) SHOWCASE

(75) Inventors: Atsuo Otsuki, Gunma-ken (JP); Yoichi Amari, Ota (JP); Tetsuya Oketani, Ota (JP); Sakumi Shibusawa, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 308 days.

(21) Appl. No.: 12/370,190

(22) Filed: Feb. 12, 2009

(65) Prior Publication Data

US 2009/0207593 A1 Aug. 20, 2009

(30) Foreign Application Priority Data

Feb. 19, 2008 (JP) ..... 2008-37111

(51) Int. Cl.
*F25D 27/00* (2006.01)
*A47F 11/10* (2006.01)

(52) U.S. Cl. ..... 362/126; 362/125; 362/92; 362/133; 362/147

(58) Field of Classification Search ..... 362/125, 362/126, 133, 92, 147, 294
See application file for complete search history.

(56) References Cited

U.S. PATENT DOCUMENTS

| | | | | |
|---|---|---|---|---|
| 7,572,025 | B2 * | 8/2009 | Shibusawa et al. | 362/92 |
| 7,857,473 | B2 * | 12/2010 | Shibusawa et al. | 362/92 |
| 2007/0195535 | A1 * | 8/2007 | Artwohl et al. | 362/341 |
| 2009/0207592 | A1 * | 8/2009 | Otsuki et al. | 362/125 |

FOREIGN PATENT DOCUMENTS

| | | |
|---|---|---|
| JP | 5-146346 | 6/1993 |

* cited by examiner

*Primary Examiner* — Stephen F Husar
*Assistant Examiner* — James Cranson, Jr.
(74) *Attorney, Agent, or Firm* — Kratz, Quintos & Hanson, LLP

(57) ABSTRACT

An object is to provide a showcase capable of improving the appearance of an illumination apparatus and also capable of improving the effects of illumination by the illumination apparatus. In the showcase, the inside of a display chamber formed in a main body thereof is illuminated with the illumination apparatus. The illumination apparatus includes: a plurality of LED illumination components equipped with LED elements; a holding member attached to the main body to hold the LED illumination components; a wiring connector provided between the LED illumination components; and a reflecting plate covering the connector.

2 Claims, 5 Drawing Sheets

SHOWCASE

BACKGROUND OF THE INVENTION

The present invention relates to a showcase in which the inside of a display chamber formed in the main body thereof is illuminated with an illumination apparatus.

Conventional showcases of the above-mentioned type include an open showcase as shown in, for example, Patent Document 1. In such an open showcase, cold air is discharged from an outlet formed at the lower edge of an opening in an insulating wall substantially U-shaped in section toward an inlet at the lower edge of the opening, thereby forming a cold air curtain at the opening. Thus, the inside of a display chamber enclosed by the insulating wall is cooled at a predetermined temperature. Further, a plurality of fluorescent lamps are attached to, for example, a canopy located outside the upper edge of the opening, to both side edges of the openings and to the lower surface of the front of a shelf in order to illuminate the inside of the display chamber and the showcase itself (e.g., see Japanese Patent Application Laid-Open No. 5-146346 (Patent Document 1)).

However, in the conventional open showcase, the fluorescent lamps are used as illumination apparatuses, and the fluorescent lamps are provided, for example, at the front of the upper part of the display chamber and in the lower surface of the shelf put up in the display chamber. This is a disadvantage in that heat load is produced in the display chamber due to the illumination with the fluorescent lamps. In general, a fluorescent lamp converts electric energy into visible radiation, infrared radiation and ultraviolet radiation, and emits visible light, so that the fluorescent lamp is used as illumination. Heat loss is produced at this point, which disadvantageously causes the inside of the display chamber to be heated not only by the fluorescent lamp itself but also by the radiant heat of the fluorescent lamp.

Therefore, cooling efficiency decreases in a cooling showcase which cools the inside of a display chamber at a predetermined temperature because this showcase performs a cooling operation considering the heat load resulting from the illumination. This disadvantageously increases running costs. Another disadvantage is that ultraviolet rays falling on commodities displayed in the display chamber have an adverse effect on the commodities. Still another disadvantage is that the fluorescent lamp uses an alternating current and has the problem of flickering, and thus has an adverse effect on the eyes.

Moreover, the fluorescent lamp has to be replaced when a luminance decrease or lighting defect is caused by deterioration over time. This forces a user to replace the fluorescent lamp, which is unfortunately a troublesome work. There is a need for a constant stock of new fluorescent lamps for replacement, and a storage place for the fluorescent lamps needs to be secured. Furthermore, the fluorescent lamp contains mercury, which disadvantageously prevents the used fluorescent lamp from being easily discarded.

Accordingly, LED illumination components equipped with LED elements have recently been employed to replace the fluorescent lamps. In this case, chip-type LED elements are mainly employed to reduce costs. A plurality of LED elements are arrayed and provided under shelves and in a canopy as LED illumination components.

In this case, the illumination apparatus may be composed of a single LED illumination component laterally provided at the front opening of the display chamber. However, in order to reduce manufacturing costs and to improve handleability, the illumination apparatus can be composed of a plurality of LED illumination components.

However, in this case, lead wires drawn from the LED illumination components are removably connected between the LED illumination components by a wiring connector. This wiring connector is disposed along a substrate to which the LED elements are attached, and is hidden together with the LED elements by, for example, a shade.

In this connection, the shade is made of a light-transmitting, colorless and transparent material to ensure light transmitting properties. Thus, the wiring connector is visible to the outside through the shade, which disadvantageously impairs the appearance. Moreover, the wiring connector is disposed in the vicinity of the LED element, so that light radiated from the LED element is blocked by the wiring connector. This disadvantageously prevents the inside of the display chamber from being effectively illuminated.

Furthermore, the LED element is more of a point light source in contrast with the thick fluorescent lamp. It is therefore disadvantageous that if light of the LED element is blocked by, for example, commodities placed on the shelf, the light does not reach farther, so that it is dark in the inner part of the display chamber and the effects of illumination decrease. Therefore, even if an LED illumination component enabling a predetermined intensity of illumination is provided in the canopy, it is unfortunately impossible to effectively illuminate the inside of the display chamber, particularly, the inner upper part of the display chamber.

The present invention has been made to solve the problems of the conventional arts, and is directed to provide a showcase capable of improving the appearance of an illumination apparatus and also capable of improving the effects of illumination by the illumination apparatus.

SUMMARY OF THE INVENTION

According to a first aspect of the invention of the present application, there is provided a showcase in which the inside of a display chamber formed in a main body thereof is illuminated with an illumination apparatus, the illumination apparatus including: a plurality of LED illumination components equipped with LED elements; a holding member attached to the main body to hold the LED illumination components; a wiring connector provided between the LED illumination components; and a reflecting plate covering the connector.

According to a second aspect of the invention, in the showcase, the display chamber has a front opening, and cold air is discharged from a cold air outlet provided at the upper edge of the front opening and sucked in from a cold air inlet provided at the lower edge of the opening such that a cold air curtain is formed at the front opening of the display chamber; and the illumination apparatus is attached to a ceiling of the display chamber in the rear of the cold air outlet, and light from the LED elements is radiated backwardly downward and toward the surface of the ceiling.

According to a third aspect of the invention, the showcase comprises an attachment member attached to the ceiling of the display chamber, wherein the holding member is attached to the attachment member in a removably engaged manner.

According to the first aspect of the invention, there is provided a showcase in which the inside of a display chamber formed in a main body thereof is illuminated with an illumination apparatus, the illumination apparatus including: a plurality of LED illumination components equipped with LED elements; a holding member attached to the main body to hold the LED illumination components; a wiring connector provided between the LED illumination components; and a reflecting plate covering the connector. In consequence, the connector can be hidden by the reflecting plate, and the appearance can be improved.

Moreover, the light from the LED elements diffusely reflected in the holding member can be further reflected toward the outside, and the inside of the display chamber can be more effectively illuminated.

According to the second aspect of the invention, in addition to the above aspect, the display chamber has a front opening, and cold air is discharged from a cold air outlet provided at the upper edge of the front opening and sucked in from a cold air inlet provided at the lower edge of the opening such that a cold air curtain is formed at the front opening of the display chamber; and the illumination apparatus is attached to a ceiling of the display chamber in the rear of the cold air outlet, and light from the LED elements is radiated backwardly downward and toward the surface of the ceiling. In consequence, effective illumination can be achieved in the backwardly downward direction and on the surface of the ceiling.

Thus, when, for example, a plurality of shelves are put up in the display chamber, the top and inner part of the shelf on the uppermost stage can be more brightly illuminated. Floating-like illumination effects can improve the appearance and impression of the whole showcase, and can also make the top of the display chamber look wider.

According to the third aspect of the invention, in addition to the above aspect, the showcase comprises an attachment member attached to the ceiling of the display chamber, wherein the holding member is attached to the attachment member in a removably engaged manner. In consequence, the LED illumination component can be easily attached to the ceiling of the display chamber. The attachment/detachment of the illumination apparatus itself is easy, and the efficiency of maintenance is therefore improved.

DETAILED DESCRIPTION OF THE INVENTION

Figure 1:
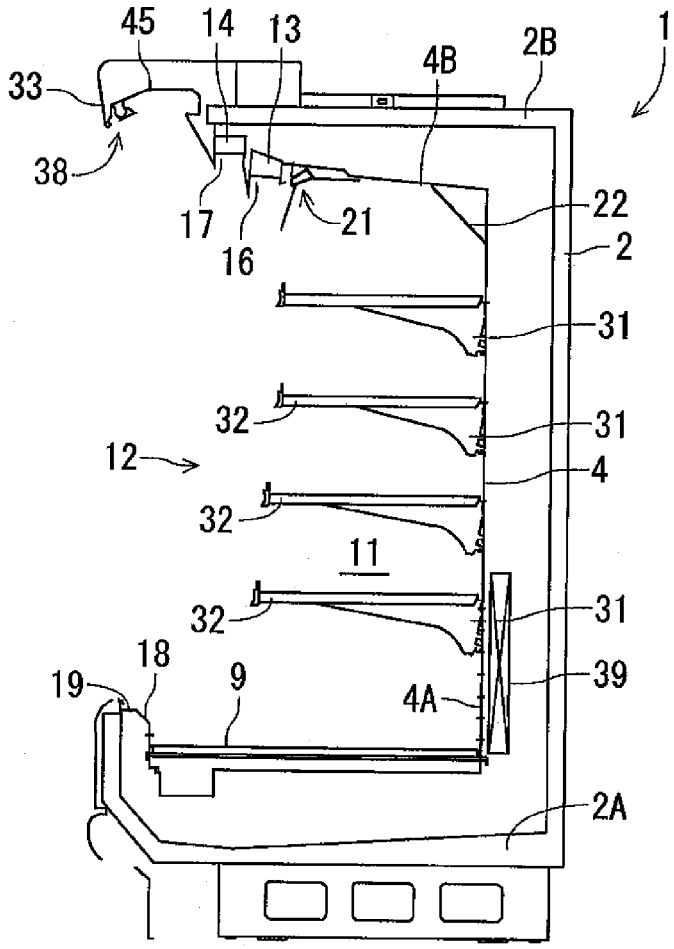
FIG. 1 is a longitudinal sectional side view of a showcase to which the present invention is applied.
Figure 2:
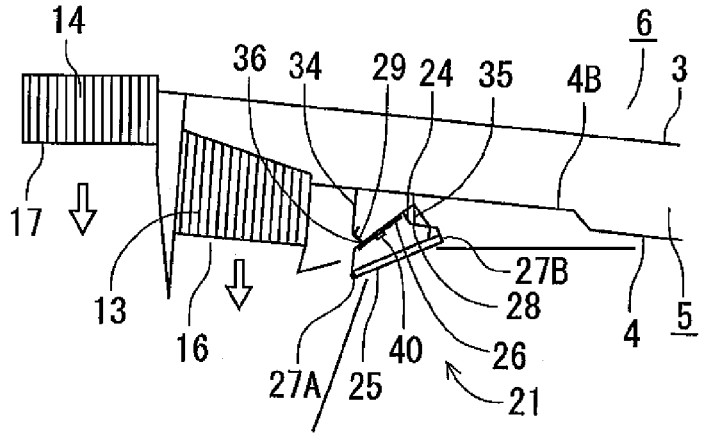
FIG. 2 is a partially enlarged view of FIG. 1.

Embodiments of the present invention will hereinafter be described with reference to the drawings. FIG. 1 shows a longitudinal sectional side view of a showcase 1 to which the present invention is applied. FIG. 2 shows a partially enlarged view of FIG. 1. The showcase 1 is a vertical open showcase installed in, for example, a store such as a supermarket. The main body of the showcase 1 is composed of an insulating wall 2 substantially U-shaped in section and having a front opening, and unshown insulating side plates attached to the side surfaces of the insulating wall 2 at an installation site.

A partition plate 4 and another partition plate 3 (only shown in FIG. 2) are attached to the inside of the insulating wall 2 of the showcase 1 with a space therebetween. Two layers of inner and outer ducts 5, 6 (only shown in FIG. 2) are formed between the partition plate 4, etc. and the insulating wall 2. A bottom plate 9 is attached to the front of the lower edge of a rear partition plate 4A constituting an inner partition plate so that a space for the ducts is left between the bottom plate 9 and a bottom wall 2A of the insulating wall 2. A display chamber 11 is formed inside the partition plate 4 and the bottom plate 9.

The partition plate 4 is composed of the rear partition plate 4A and a ceiling partition plate 4B. Here, the ceiling partition plate 4B is formed with a predetermined angle of inclination so that its front end is higher than its rear end as shown in FIG. 1. A mirror member 22 is provided at a corner formed by the rear partition plate 4A and the ceiling partition plate 4B so as to face the display chamber 11 (obliquely below).

Furthermore, pairs of brackets 31 and shelf boards 32 are put up on a plurality of stages in the display chamber 11. The brackets 31 can change height and attachment angles, and are attached to an unshown prop at the back of the display chamber 11. The shelf boards 32 constitute shelves together with the brackets 31.

An inner outlet 16 and an outer outlet 17 to which honeycomb members 13, 14 are attached are provided side by side at the upper edge of a front opening 12 of the insulating wall 2. The inner outlet 16 and the outer outlet 17 are in communication with the inner duct 5 and the outer duct 6, respectively. Moreover, an inner inlet 18 and an outer inlet 19 are provided side by side at the lower edge of the opening 12.

On the other hand, a plurality of unshown blowers corresponding to the inner duct 5 and the outer duct 6 are placed on the bottom wall 2A of the insulating wall 2 under the rear of the bottom plate 9.

A cooler 39 of cooling equipment is longitudinally provided in the inner duct 5 in the rear of the rear partition plate 4A. When the blower corresponding to the inner duct 5 is operated, cold air which has been subjected to heat exchange with the cooler 39 is lifted through the inner duct 5, and discharged from the inner outlet 16 toward the inner inlet 18. Then, the cold air drawn in from the inner inlet 18 is again accelerated by the same blower.

On the other hand, when the blower corresponding to the outer duct 6 is operated, air in the outer duct 6 is lifted through the outer duct 6, and discharged from the outer outlet 17 toward the outer inlet 19. Then, the air drawn in from the outer inlet 19 is again accelerated by the same blower. As a result, front and rear two air curtains are formed at the opening 12, and part of the inner cold air curtain is circulated into the display chamber 11 and cools down the display chamber 11.

Figure 3:
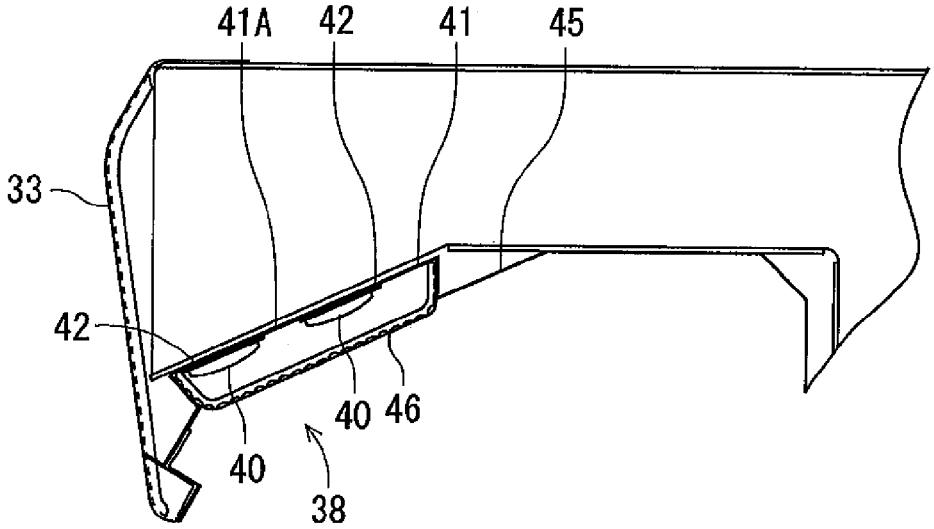
FIG. 3 is a partially enlarged view of FIG. 1.
Figure 4:
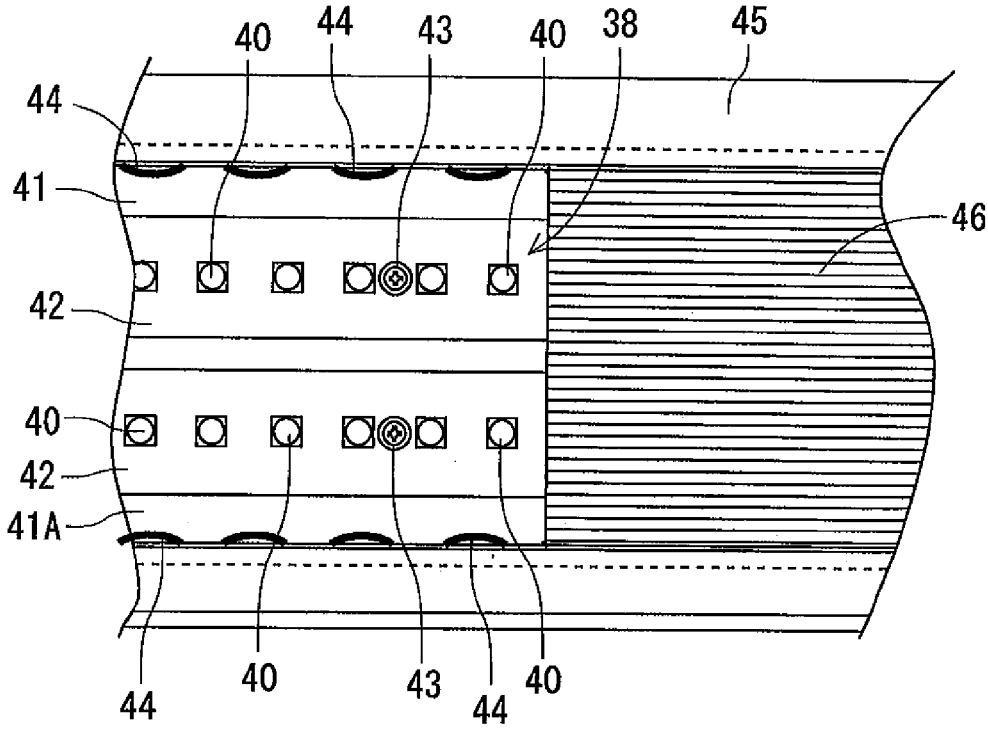
FIG. 4 is a view showing how an LED illumination component is attached.

Next, the configuration of the front of a ceiling wall 2B of the insulating wall 2 is described with reference to FIG. 3 and FIG. 4. FIG. 3 is a partially enlarged view of FIG. 1. FIG. 4 is a view showing how an LED illumination component 38 is attached.

A forwardly projecting canopy 33 is attached to the front end (the front end of the upper part) of the ceiling wall 2B of the insulating wall 2. A reflecting plate 45 extending outside the front opening 12 of the insulating wall 2 is attached to the inside of the canopy 33.

The reflecting plate 45 is formed of a metal plate with a decoration coating. A longitudinally recessed illumination attachment portion 41 is formed at the front of the reflecting plate 45. The illumination attachment portion 41 is open toward the front opening 12 of the display chamber 11 located below at the back. The front and rear edges of the illumination attachment portion 41 are formed with slight inclinations so as to be closer to each other as the opening approaches.

Furthermore, the surface of the illumination attachment portion 41 facing the opening serves as an illumination attachment surface 41A, and is angled to face the front opening 12 of the display chamber 11 downward from above, that is, faces the display chamber 11 located obliquely below at the back. The LED illumination component 38 is attached to the illumination attachment surface 41A.

In the LED illumination component 38, a plurality of LED elements 40 are attached at predetermined intervals to a longitudinally extending substrate 42, and the substrate 42 is fixed in contact with the illumination attachment surface 41A with a plurality of fixing screws 43 . . . . In addition, the LED element 40 used in the present embodiment is a chip-type white LED illumination manufactured by Nichia Corporation (part number: NS6W083T). Moreover, one row or two or more front and rear rows of LED illumination components 38 of the LED elements 40 may be provided. Two rows are provided in the present embodiment. In the present embodiment, the front opening 12 of the open showcase 1 is formed to extend about 1830 mm, so that about 108 LED elements 40 are used. In addition, 44 in the drawing denotes a plurality of exhaust holes provided in the longitudinal direction.

Furthermore, the illumination attachment surface 41A of the illumination attachment portion 41 is covered with a shade 46 so that the LED elements 40, the substrate 42 and the exhaust holes 44 are enclosed from below. The shade 46 is in a bent shape with a predetermined curvature so as to project toward the front opening 12 of the display chamber 11. In addition, the shade 46 is fitted into and thus removably attached to the illumination attachment portion 41 of the reflecting plate 45. In FIG. 4, the shade 46 is attached to part of the illumination attachment portion 41.

The shade 46 is made of a light-transmitting, colorless and transparent material. In the present embodiment, in order to diffuse light from the LED elements 40 to the front opening 12 of the display chamber 11, the surface of the shade 46 facing the LED elements 40 is formed smooth, and the outer surface of the shade 46 opposite to the LED elements 40 is wave-shaped or saw-tooth-shaped in section.

Consequently, the light which has moved straight in parallel from the LED elements 40 and entered the shade 46 can be multidirectionally refracted on the sectionally wave-shaped or saw-tooth-shaped outer surface and extensively diffused.

According to such a configuration, when the LED elements 40 are turned on, the inside of the display chamber 11 can be effectively illuminated from the front upper position outside the display chamber 11 with the irradiation light of the LED elements 40 after diffused in the shade 46.

The irradiation light from the LED elements 40 is particularly highly directive, and can therefore effectively illuminate the face of a commodity displayed on each shelf board 32, particularly, a commodity such as a milk carton or a beverage PET bottle placed upright and facing the front opening 12 of the display chamber 11.

Figure 5:
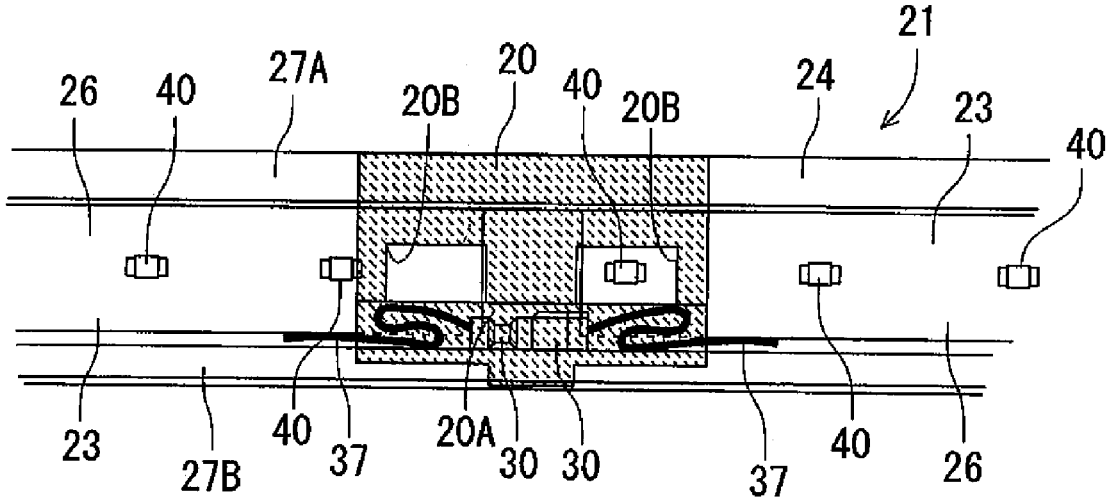
FIG. 5 is a plan view of an illumination apparatus.
Figure 6:
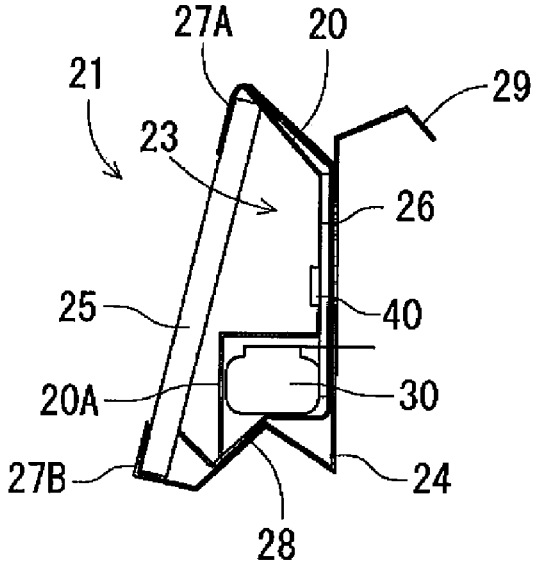
FIG. 6 is a sectional view of the illumination apparatus.

Next, an illumination apparatus 21 provided in the ceiling partition plate 4B of the display chamber 11 is described with reference to FIG. 2, FIG. 5 and FIG. 6. FIG. 5 shows a plan view of the illumination apparatus 21. FIG. 6 shows a sectional view of the illumination apparatus 21.

The illumination apparatus 21 provided in the ceiling partition plate 4B comprises a plurality of LED illumination components 23, a holding member 24 attached to the ceiling partition plate 4B to hold the LED illumination components 23, and a shade 25.

Similarly to the LED illumination component 38, the LED illumination component 23 includes a substrate 26 provided with a plurality of LED elements 40. In addition, a plurality of LED illumination components 23, for example, a row of four LED illumination component 23 are provided in the longitudinal direction of the display chamber 11. Further, the LED elements 40 provided in each of the LED illumination components 23 are arranged at greater intervals than when provided in the LED illumination component 38 (i.e., the total number of the LED elements 40 attached is about half).

The holding member 24 laterally extends over the ceiling partition plate 4B of the display chamber 11 in the rear of the inner outlet 16. The holding member 24 is made of a metal having satisfactory thermal conducting properties, and coated with a paint having high light reflection efficiency. The holding member 24 is substantially U-shaped in section. Inwardly bent shade holding portions 27A, 27B are formed at both ends of the opening of the holding member 24.

A recess 28 is formed due to the bending in the back wall of the holding member 24 facing the rear of the display chamber 11 or the ceiling partition plate 4B when the holding member 24 is attached to the ceiling partition plate 4B. The recess 28 is removably engaged with an engaging portion 35 of an attachment member 34 described later.

On the other hand, an engaging portion 29 extending on the side of the ceiling partition plate 4B is formed in a bent state on the front wall side of the holding member 24 facing the front of the display chamber 11. The engaging portion 29 is removably engaged with an engaging portion 36 of the attachment member 34.

Furthermore, the LED illumination components 23 are screwed to or fixed with, for example, a double-faced adhesive tape to the surface of the holding member 24 facing the sectionally U-shaped opening so as to face the shade 25 provided at the opening.

Here, a lead wire 37 for feeding electricity from each substrate 26 to the LED elements 40 is drawn at the end of each of the LED illumination components 23. A wiring connector 30 for wire connection to the lead wire 37 of the adjacent LED illumination component 23 is provided at the end of the lead wire 37. Thus, when the LED illumination components 23 are attached, the wiring connectors 30 of the lead wires 37, 37 drawn from the adjacent LED illumination components 23 are connected together.

Then, a reflecting plate 20 (indicated with hatching in FIG. 5) covering the wiring connectors 30 is removably attached to the part where the wiring connectors 30 are disposed. In the present embodiment, the reflecting plate 20 is coated with a paint having high light reflection efficiency similarly to the holding member 24, and has a section formed along the shape of the inner surface of the holding member 24. Further, a connector housing portion 20A projecting toward the shade 25 is formed in the part of the reflecting plate 20 for housing the wiring connectors 30.

Furthermore, LED through holes 20B are formed in the parts of the reflecting plate 20 corresponding to the LED elements 40 so as to transmit the light radiated from the LED elements 40 provided at the ends of the LED illumination components 23.

In addition, the reflecting plate 20 may be, without limitation, removably engaged by the corners of the shade holding portions 27A, 27B of the holding member 24. Alternatively, the reflecting plate 20 may be fixable to the holding member 24 with unshown fixing screws.

On the other hand, the plurality of attachment members 34 are screwed at predetermined intervals to the lower surface of the ceiling partition plate 4B in the rear of the inner outlet 16. For example, as shown in FIG. 2, the attachment member 34 is substantially U-shaped in section to have a downward opening. The engaging portions 35, 36 for detachably holding the holding member 24 are formed at both lower ends of the attachment member 34.

The procedure of attaching the illumination apparatus 21 to the ceiling partition plate 4B is described according to such a configuration. First, the LED illumination components 23 are attached to the surface facing the opening of the holding member 24. Then, the wiring connector 30 of the lead wire 37 drawn from each of the LED illumination components 23 is connected to the wiring connector 30 of the adjacent LED illumination component 23.

Subsequently, the reflecting plate 20 is attached from the side of the opening of the holding member 24 so as to cover the wiring connector 30. Then, the shade 25 is locked by the shade holding portions 27A, 27B formed in the opening of the holding member 24.

Furthermore, the holding member 24 to which the LED illumination components 23 are attached is attached to the attachment member 34 fixed to the ceiling partition plate 4B. That is, in the present embodiment, the engaging portion 29 (front wall side) formed in the holding member 24 is locked to the engaging portion 36 formed at the front of the attachment member 34, and then the recess 28 (rear wall side) formed in the holding member 24 is locked to the engaging portion 35 formed at the back of the attachment member 34.

Consequently, the holding member 24 is attached to the ceiling partition plate 4B in the rear of the inner outlet 16. At this moment, the recess 28 formed in the back wall of the holding member 24 provided with the LED illumination components 23 is engaged by the engaging portion 35 at the back of the attachment member 34 while the engaging portion 29 in the front wall is engaged with the engaging portion 36 at the front of the attachment member 34. Thus, the LED elements 40 of the LED illumination components 23 are downwardly attached toward the rear of the display chamber 11.

Consequently, the light radiated from the illumination apparatus 21 falls backwardly downward, and can therefore illuminate the top of the shelf on the uppermost stage put up in the display chamber 11 as shown in FIG. 1. Moreover, the ceiling partition plate 4B to which the illumination apparatus 21 is attached is formed with inclination so that its front end is higher than its rear end. Thus, the light radiated from the illumination apparatus 21 provided at the front of the ceiling partition plate 4B is emitted toward the rear of the ceiling partition plate 4B.

As a result, the rear lower part and ceiling surface can be effectively illuminated with the LED elements 40 of the illumination apparatus 21 provided at the front of the ceiling of the display chamber 11. Therefore, when the shelves are put up on a plurality of stages in the display chamber 11 as in the present embodiment, the top and inner part of the shelf board 32 on the uppermost stage can be more brightly illuminated. Floating-like illumination effects can improve the appearance and impression of the whole showcase, and can also make the top of the display chamber 11 look wider.

In particular, in the present embodiment, the mirror member 22 facing the display chamber 11 is provided at the corner formed by the ceiling partition plate 4B and the rear partition plate 4A. Thus, the light radiated from the illumination apparatus 21 is more reflected toward the display chamber 11, and the effects of illuminating the top of the shelf board 32 on the uppermost stage can be improved.

Furthermore, in the present embodiment, the wiring connector 30 provided between the LED illumination components 23 held by the holding member 24 is covered with the reflecting plate 20 as described above, so that the wiring connector 30 can be hidden. This prevents the trouble of the wiring connector 30 being seen through the shade 25, thus resulting in an improvement in appearance.

The light from the LED elements 40 diffusely reflected in the holding member 24 can be further reflected to the outside (the inside of the display chamber 11 in this case) owing to the reflecting plate 20. Thus, the adverse effect of the presence of the wiring connector on the illumination is alleviated, and the inside of the display chamber 11 can be more effectively illuminated.

Figure 7:
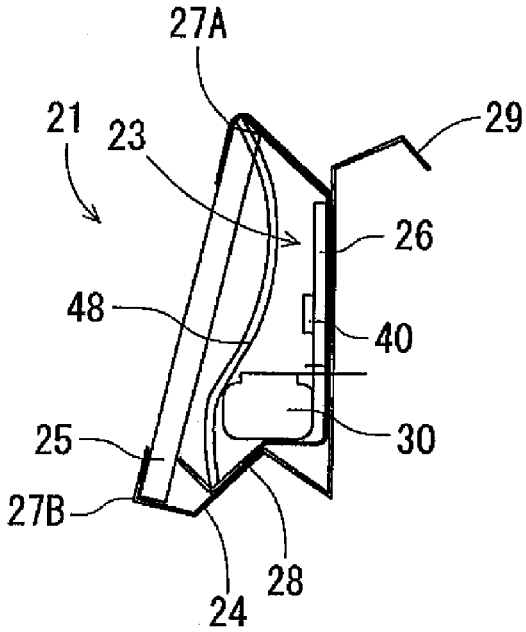
FIG. 7 is a sectional view of an illumination apparatus as another embodiment.

In addition, the reflecting plate 20 is formed along the sectional shape of the holding member 24 in the present invention as described above, but this is not a limitation. For example, as shown in FIG. 7, a reflecting plate 48 may be made of a flexible material, and its both ends may be stored in a bent state in the holding member 24 and engaged with the shade holding portions 27A, etc., so that the reflecting plate 48 can be removably attached.

Figure 8:
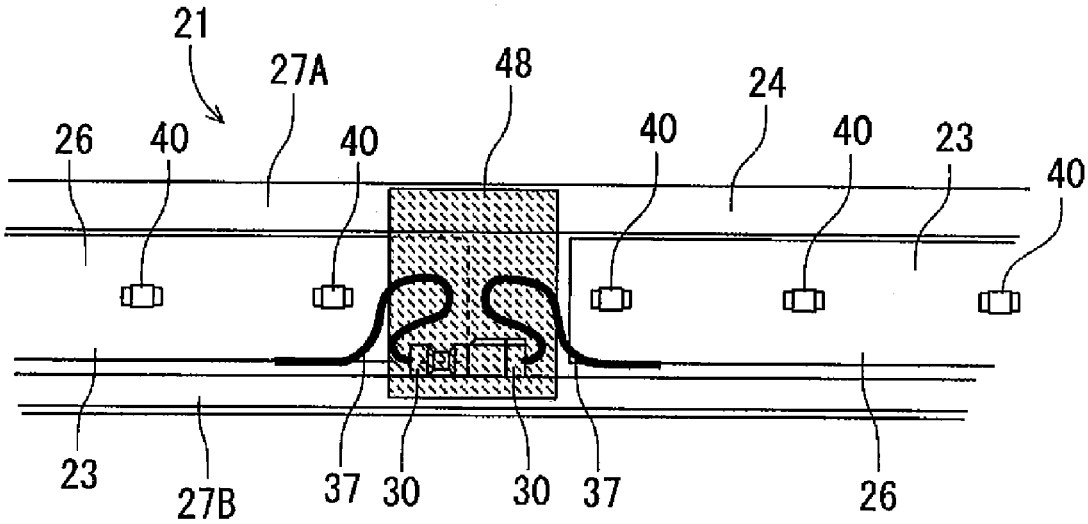
FIG. 8 is a plan view of an illumination apparatus as another embodiment.

Furthermore, the reflecting plate 20 is formed wide to cover the wiring connector 30 between the ends of each of the LED illumination components 23 in the present embodiment, but this is not a limitation. The above-mentioned reflecting plate 48 may be formed so wide as to be able to cover the wiring connector 30 as shown in FIG. 8.

In addition, the illumination apparatus 21 is attached to what is called the vertical open showcase by way of example in the embodiment described above, but this is not a limitation. A reach-in showcase or a flat open showcase can also bring about similar effects owing to the reflecting plate 20, 48 as long as such a showcase uses the wiring connectors 30 to connect the plurality of LED illumination components 23 together.

Furthermore, as described above, the illumination apparatus 21 attached to the ceiling of the display chamber 11, that is, to the ceiling partition plate 4B can be attached by the removable engagement of the holding member 24 with the attachment member 34 previously fixed to the ceiling partition plate 4B. Thus, the LED illumination components 23 can be easily attached to the ceiling of the display chamber 11. The attachment/detachment of the illumination apparatus 21 itself is easy, and the efficiency of maintenance is therefore improved.

Figure 9:
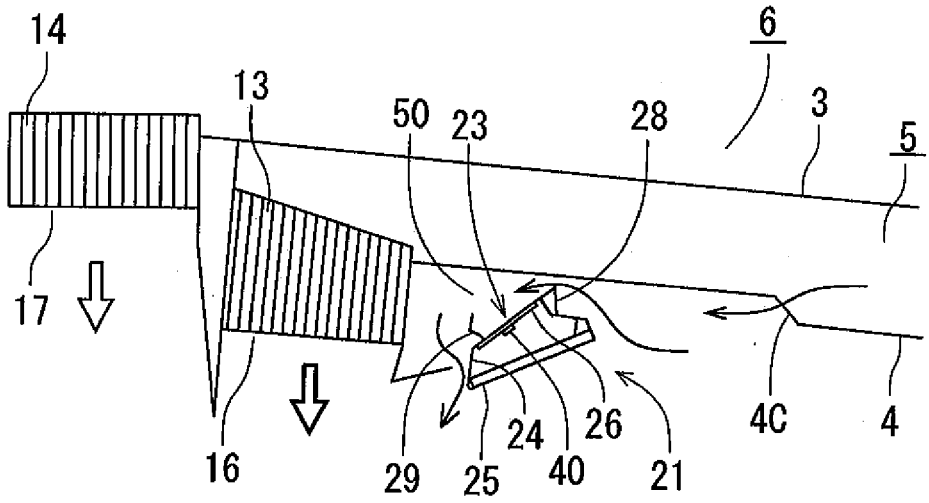
FIG. 9 is a partially enlarged sectional view of a showcase as another embodiment.

Moreover, as shown in FIG. 9, a downward step 4C may be formed in the ceiling partition plate 4B located in the rear of the illumination apparatus 21, and a plurality of unshown through holes may be provided in the front surface (inclined surface) of the step 4C.

Then, part of the cold air circulating through the inner duct 5 from the through holes may be directly discharged into the display chamber 11 as indicated by a solid arrow in FIG. 9, and the cold air may be circulated through a gap 50 formed between the attachment members 34 as indicated by a solid arrow in FIG. 9.

Consequently, waste heat from the substrate 26 generated due to the power application to the LED elements 40 can be cooled down by the cold air circulation. This makes it possible to prevent and inhibit the deterioration and breakdown of the LED illumination components 23.

Figure 10:
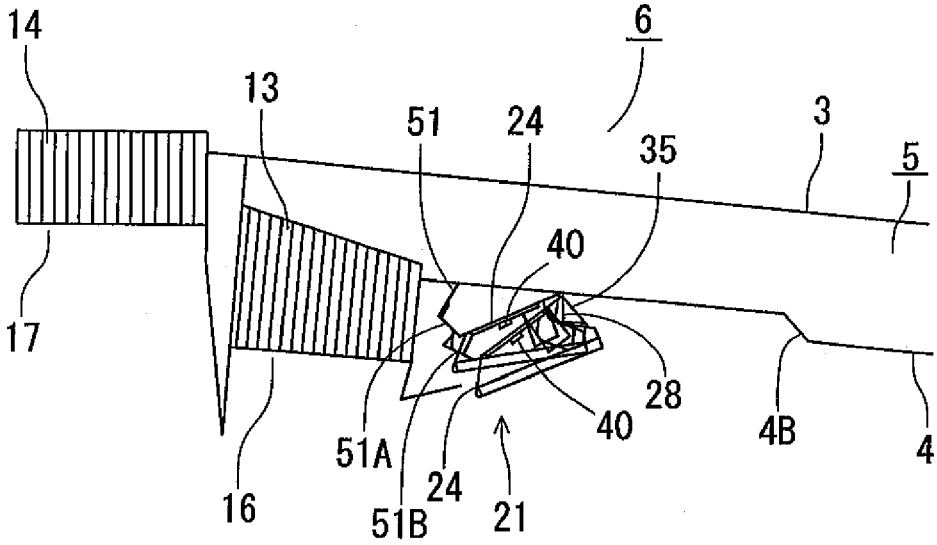
FIG. 10 is a partially enlarged sectional view of a showcase as another embodiment.

Furthermore, the illumination apparatus 21 can only be attached at a predetermined angle by the engaging portions 35, 36 provided in the attachment member 34 in the present embodiment, but this is not a limitation. As shown in FIG. 10, engaging portions 51A, 51B . . . which enable the illumination apparatus 21 to be held at a plurality of different angles may be formed at the front of an attachment member 51, and the engaging portion of the attachment member 51 to be engaged with the engaging portion 29 of the holding member 24 may be changed so that the attachment angle of the illumination apparatus 21 can be changed.

This makes it possible to freely change the angle of illumination in accordance with the purpose of use and achieve various kinds of illumination.

What is claimed is:

1. A showcase in which the inside of a display chamber formed in a main body thereof is illuminated with an illumination apparatus, the illumination apparatus including:

a plurality of LED illumination components equipped with LED elements;

a holding member attached to the main body to hold the LED illumination components;

a wiring connector provided between the LED illumination components; and a reflecting plate covering the connector, wherein the display chamber has a front opening, and cold air is discharged from a cold air outlet provided at the upper edge of the front opening and sucked in from a cold air inlet provided at the lower edge of the opening such that a cold air curtain is formed at the front opening of the display chamber; and the illumination apparatus is attached to a ceiling of the display chamber in the rear of the cold air outlet, and light from the LED elements is radiated backwardly downward and toward the surface of the ceiling.

2. The showcase according to claim 1, comprising an attachment member attached to the ceiling of the display chamber, wherein the holding member is attached to the attachment member in a removably engaged manner.

* * * * *